US005989109A

United States Patent [19]

Kobayashi et al.

[11] Patent Number: 5,989,109

[45] Date of Patent: Nov. 23, 1999

[54] SEAL PROTECTING METHOD FOR USE WITH SPIRAL-FLOW BARREL FINISHING MACHINE AND SPIRAL-FLOW BARREL FINISHING MACHINE WITH SEAL PROTECTING APPARATUS

[75] Inventors: Hisamine Kobayashi; Katsuhiro Izuhara, both of Nagoya, Japan

[73] Assignee: Tipton Corp, Aichi, Japan

[21] Appl. No.: 08/887,639

[22] Filed: Jul. 3, 1997

[51] Int. Cl.[6] ..... B24B 31/00

[52] U.S. Cl. ..... 451/326; 451/327; 451/328

[58] Field of Search ..... 451/326, 327, 451/328, 329, 64, 104, 113; 384/478; 277/433

[56] References Cited

U.S. PATENT DOCUMENTS

| | | | |
|---|---|---|---|
| 5,012,620 | 5/1991 | McNeil | 451/327 |
| 5,119,597 | 6/1992 | Davidson | 451/326 |
| 5,279,074 | 1/1994 | Davidson | 451/326 |
| 5,476,415 | 12/1995 | Nishimura et al. | 451/326 |

*Primary Examiner*—David A. Scherbel
*Assistant Examiner*—Derris Holt Banks
*Attorney, Agent, or Firm*—Wenderoth, Lind & Ponack, L.L.P.

[57] ABSTRACT

Any part of an abrasive media in a solid particle or liquid form is prevented from entering a seal and/or the area where a rotary shaft bearing for a rotating barrel is sealed, thereby protecting the bearing and/or its seal against any possible damage that may be caused by abrasive media. A the barrel finishing operation performed by rotating a rotating barrel rotatably mounted inside a cylindrical stationary barrel on a lower portion thereof in a spaced relationship to the stationary barrel. The stationary barrel has an outer bottom plate at the bottom end thereof. At least one blade is mounted on the back side of a rotating plate forming the bottom end of the rotating barrel, and is rotated by rotating the rotating plate to any part of the abrasive media existing between the back side of the rotating plate and the top side of the outer bottom plate in the direction remote from the rotary shaft, thereby developing a negative pressure or vacuum area located on the back side of the rotating plate and on the side of the blade nearer to the rotary shaft. Air is then drawn from the atmosphere into the vacuum area by the action of the negative pressure, and thus an air layer is created in the vacuum area. The air layer prevents that part of the abrasive media from entering the rotary shaft bearing and/or its seal.

4 Claims, 4 Drawing Sheets

SEAL PROTECTING METHOD FOR USE WITH SPIRAL-FLOW BARREL FINISHING MACHINE AND SPIRAL-FLOW BARREL FINISHING MACHINE WITH SEAL PROTECTING APPARATUS

BACKGROUND OF THE INVENTION

1. Field of the Invention

The present invention relates generally to a barrel finishing machine that includes a cylindrical stationary barrel having an outer bottom plate at the bottom end thereof, and a rotating barrel rotatably mounted inside the stationary barrel on the lower portion of the stationary barrel in a spaced relationship to the stationary barrel and containing abrasive media including any required water and compound, if required, and workpieces being surface-finished and the like by the abrasive media, whereby the workpieces may be surface-finished by rotating the rotating barrel. More particularly, the present invention relates to a seal protecting method and apparatus for use with a spiral-flow barrel finishing machine that prevents any part of the abrasive media in solid particle and/or liquid form resulting from the surface finishing from entering the bearing for the rotary shaft and its seal, thereby protecting the bearing or its seal from any possible damage that may be caused by the abrasive media.

2. Description of the Prior Art

It is known in the art that a seal cover is provided on a boss in the bottom plate of the rotating barrel to prevent any possible damage to the seal element or bearing element in the spiral-flow barrel finishing machine (for example, Japanese Utility Model application No. Heisei 6 (1994)-42058 as now published). It is also known in the art that a stirring section is provided behind a dishlike bottom plate on the rotating barrel (for example, Japanese Utility Model application No.Heisei 6 (1994)-31944 as now published).

It is recognized that the inventions disclosed in the applications mentioned above may be effective, respectively, in preventing damage to the seal element and the bearing element and the like, but if the abrasive media in its liquid form contains large quantities of solid particles or grains that may be produced when the particular surface finishing operation such as a rough finishing operation, occurs, those grains will tend to build up in those areas which are located on the outer bottom plate of the cylindrical stationary barrel, such as the areas closer to the rotary shaft, where the liquid abrasive media is flowing relatively slowly. Those inventions therefore could not adequately prevent any possible damage to the seal element and the like.

SUMMARY OF THE INVENTION

Accordingly, the present invention proposes to provide a seal protecting method that may be used in a barrel finishing operation that is performed by a spiral-flow barrel finishing machine that includes a cylindrical stationary barrel having an outer plate at the bottom end thereof, and a rotating barrel rotatably mounted inside a cylindrical stationary barrel on the lower portion thereof in a spaced relationship to the stationary barrel. The said rotating barrel contains an abrasive media including water and compound, if required, and workpieces being surface finished and the like by the abrasive media.

More particularly, the method of the present invention that is specifically intended for use with a spiral-flow barrel finishing machine comprises the steps of rotating the rotating barrel about its rotary shaft and thereby rotating at least one blade mounted on the back side of the rotating plate forming the bottom end of the rotating barrel. This causes the rotating blade to repel a part of the abrasive media exisiting in its solid particle or liquid form between the back side of the rotating plate and the outer bottom plate of the stationary barrel in the direction remote from the rotary shaft, developing a negative pressure or vacuum in the area located on the back side of the rotating plate and on the inner side of the blade (nearer to the rotary shaft), creating an air layer in the said negative pressure or vacuum area by drawing air from the atmosphere into the said negative pressure or vacuum area under the action of the negative pressure or vacuum, and preventing the abrasive media in its solid particle or liquid form (resulting from the finishing operation) from entering into the area where the rotary shaft or its bearing is sealed, under the action of the created air layer.

The present invention also proposes to provide a barrel finishing machine with a seal protecting apparatus, more particularly, a spiral-flow barrel finishing machine with seal protecting apparatus that includes a cylindrical stationary barrel having an outer bottom plate at the bottom end thereof, and a rotating barrel rotatably mounted inside the stationary barrel on the lower portion thereof in a spaced relationship to the cylindrical stationary barrel. The rotating barrel contains an abrasive media including water and compound, if required, and workpieces being surface finished and the like by the abrasive media. The before described seal protecting apparatus of the present invention includes at least one blade mounted on the back side of the rotating plate forming the bottom of the rotating barrel and located nearer to the rotary shaft of the rotating barrel, and an air inlet communicative with the atmosphere provided on the back side of the rotating plate and in a closer proximity to the rotary shaft than the location of the blade.

The blade on the back side of the rotating plate forming the bottom of the rotating barrel may be rotated with the rotating barrel when it is rotated, and may serve to both repel the part of the abrasive media existing in its solid particle or liquid form between the back side of the rotating plate and the outer bottom plate of the stationary barrel in the direction remote from the rotary shaft, and to develop a negative pressure or vacuum in the area located on the back side of the rotating plate and on the inner side of the blade (nearer to the rotary shaft).

The air inlet on the back side of the rotating plate may serve to draw air from the atmosphere into the area where the negative pressure or vacuum is developed by the blade as it is rotating, under the action of the negative pressure or vacuum, thereby creating an air layer in the negative pressure or vacuum area.

The blade may include more than one blade secured to the back side of the rotating plate forming the bottom of the rotating barrel and arranged at regular intervals circumferentially and coaxially with the rotary shaft. The bottom side of the blades and the top side of the outer bottom plate of the stationary barrel are maintained to be spaced as small as possible with regard to each other, and are also maintained to face oppositely to each other in parallel planes.

The air from the atmosphere may be introduced through the air inlet by any appropriate means. The blade may be formed like a rectangular prism having an area, opposite the top side of the outer bottom plate of the stationary barrel, that is large enough to resist any wear. Preferably, the gap between the bottom side of the blade and the top side of the outer bottom plate should be as small as possible, such as 1 mm or less. By providing the gaps in this way, that part of the abrasive media that exists in its solid particle or liquid form in the gap can be repelled remotely from the rotary shaft by the rotating blades, and a negative pressure (vacuum) can be developed effectively in the area located under the back side of the rotating plate of the rotating barrel and on the inner side of the blade (nearer to the rotary shaft).

Preferably, the number of blades may be 2 to 6, but it should be understood that the present invention is not limited to this particular number. Those blades may be positioned at an angle of about 30 degrees with regard to the radial direction of the rotating barrel, as shown in FIG. 4. In this case, it should also be understood that the present invention is not limited to the particular angles.

As described briefly, that part of the abrasive media existing in its solid particle and/or liquid form between the back side of the rotating plate and the top side of the outer bottom plate of the stationary barrel can be repelled by the rotating blades so that it is prevented from entering into the seal or the area where the rotary shaft bearing is sealed. Furthermore, a negative pressure (vacuum) may be developed in the area located between the back side of the rotating plate of the rotating barrel and the outer bottom plate of the stationary barrel, and on the inner side of the blades (nearer to the rotary shaft), and air may be drawn from the atmosphere into the said negative pressure (vacuum) area by the action of the negative pressure (vacuum). An air layer may thus be created in the negative pressure (vacuum) area. This air layer prevents any abrasive media from entering into the seal or the area where the rotary shaft bearing is sealed, thereby preventing it from building up in that area.

According to the present invention, a number of blades 11 are securely fixed to the back side of the rotating barrel 3 in close proximity to the rotary shaft 8 and maintaining a very small gap between the bottom side of blades 11 and the top side of the outer bottom plate. When the rotating barrel 3 is rotated, the blades 11 are also rotated. Part of the abrasive media that exists in its solid particle or liquid form in the neighborhood of the seal 16 or the area where the rotary shaft 8 or its bearing is sealed is repelled in the direction remote from the rotary shaft 8 by the blades as they are rotating. A negative pressure (vacuum) area is also developed in the area between the back side of the rotating barrel 3 and the outer bottom plate of the stationary barrel, and on the inner side of the blades 11 (nearer to the rotary shaft 8). Under the negative pressure (vacuum), air is drawn from the atmosphere into the said area through air inlets 22*b,* 22*a,* which communicate to the said area, between the back side of the rotating barrel 3 and the outer bottom plate of the stationary barrel, and on the inner side of the blades 11, so that an air layer is created at the area. The air layer prevents the abrasive media from entering into the seal 16 or the area where the bearing 17 is sealed, and protects the seal 16 or the area where the bearing 17 is sealed against any possible damage that would otherwise be caused by those abrasive media.

Testing occurred under the condition in which no blades 11 were provided on the back side of the rotating barrel 3. The results show that the seal 16 was damaged within no more than one hour. The same testing occurred, but this time under the condition in which the blades 11 were provided on the back side of the rotating barrel 3 according to the present invention. The results show that no damage was found on the seal 16 after eleven (11) hours.

DETAILED DESCRIPTION OF PREFERRED EMBODIMENTS

First Preferred Embodiment

Figure 1:
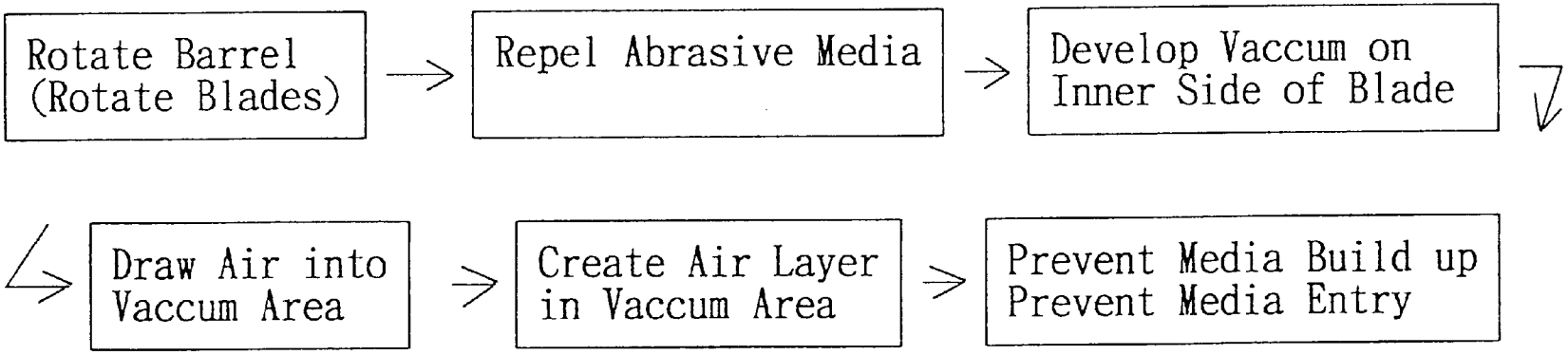
FIG. 1 is a flowchart that describes the steps of the method of the present invention.

The method of the present invention is first described by referring to the flowchart shown in FIG. 1.

The method may be used with a barrel finishing machine, more particularly, with a spiral-flow barrel finishing machine that includes a cylindrical stationary barrel having an outer bottom plate at the bottom end thereof, a rotating barrel rotatably mounted inside the stationary barrel on the lower portion thereof in a spaced relationship to the cylindrical stationary barrel, and a number of blades secured to the back side of the a rotating plate forming the bottom end of the rotating barrel in close proximity to a rotary shaft for the rotating barrel.

The method may be performed by following the steps shown in the flowchart of FIG. 1. Firstly, the rotating barrel is rotated about its rotary shaft, and the blades are then rotated together with the rotating barrel. By rotating the blades, any part of the abrasive media that exists in its solid particle or liquid form between the back side of the rotating plate and the outer bottom plate of the cylindrical stationary barrel may be repelled by the blades in a radial direction and as remotely as possible from the rotary shaft. A negative pressure (vacuum) area is then developed in the area located between the back side of the rotating plate and the outer bottom plate of the stationary barrel, and on the inner side of the blades (nearer to the rotary shaft). An air inlet which communicates with the atmosphere is provided in the area located on the back side of the rotating plate and on the inner side of the blades (nearer to the rotary shaft), through which air may be drawn from the atmosphere into this area, that is to say, into the negative pressure (vacuum) area, by the action of the negative pressure prevailing in this negative pressure (vacuum) area. An air layer is thus created in the said negative pressure (vacuum) area.

The air layer that has thus been created prevents the part of the abrasive media in its solid particle and/or liquid form from entering the seal and/or the area where the bearing is sealed, to protect the seal and/or the area where the bearing is sealed against any damage from the abrasive media, and to avoid the abrasive media building up there.

Second Preferred Embodiment

The apparatus of the present invention is described by referring to FIG. 2 through FIG. 5.

The apparatus may be used with a barrel finishing machine, more specifically, with a spiral-flow barrel finishing machine that includes a stationary barrel 1 having an inner wall lined with urethane, shown by 2, and a rotating barrel 3 having an inner wall lined with urethane, shown by 4, which is rotatably mounted inside the stationary barrel 1 on the lower portion thereof, with a small gap being maintained between the stationary and rotating barrels 1 and 3.

The stationary barrel 1 has a flange 1*a* at the bottom end thereof which engages a corresponding flange 5*a* which is provided on an outer bottom plate 5 at the top of the plate 5. Inner walls 5*b,* 5*c* of the outer bottom plate 5 are kept apart from the corresponding lower side of the rotating plate 3*a* forming the bottom end of the rotating barrel 3, a gap 6 between them providing space for accepting part of the abrasive media in a solid particle or liquid form.

The section extending from the outer perimeter of the outer bottom plate 5 to the neighborhood of the connection of an outlet pipe 7 is slanted to be low on the side of a rotary shaft 8, like the inner wall 5*b,* and the section extending from the rotary shaft 8 to the neighborhood of the connection of the outlet pipe 7 is slanted to be high on the side of the rotary shaft 8, like the inner wall 5*c*. The connection area of the outlet pipe 7 is formed to be annular, and the outlet pipe 7 is connected to the lowest point of the outer bottom plate 5 to allow automatic flow of any part of the abrasive media in its liquid form toward the outlet pipe 7.

An annular flange 9*a* for mounting a boss 9 on the rotating barrel 3 carries an annular edge member 3*b* on its upper side that is secured to the annular flange 9*a* by any suitable fastening means, such as a bolt 10, as shown. The annular flange 9*a* has a number of blades 11 on its lower side, e.g., six blades 11 in this case, which are arranged at regular intervals circumferentially about the rotary shaft 8 and are secured to the lower side of annular flange 9*a* by any suitable fastening means, such as a bolt 12, as shown.

Figure 2:
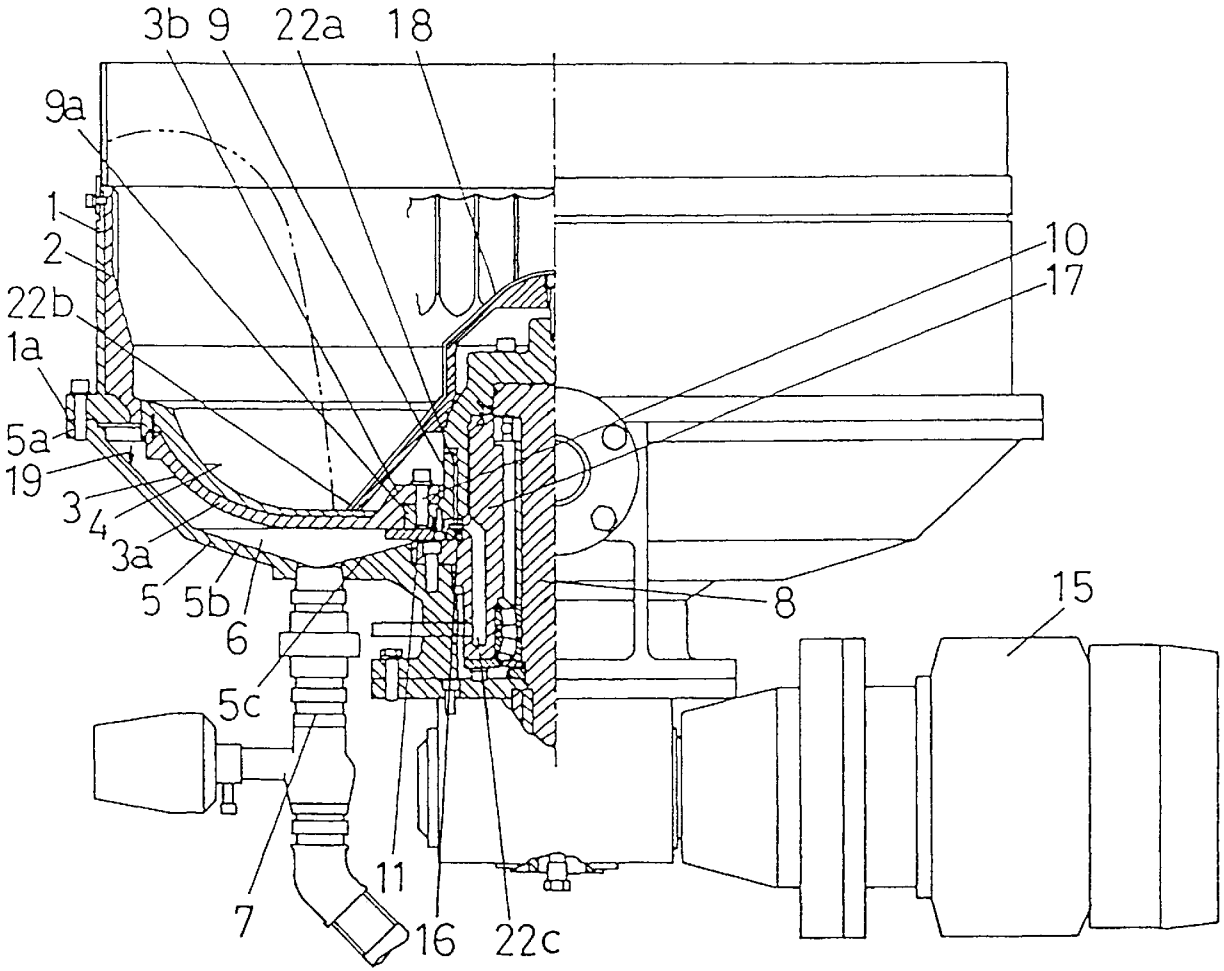
FIG. 2 is a front and partly sectional view of a preferred embodiment of the present invention.
Figure 3:
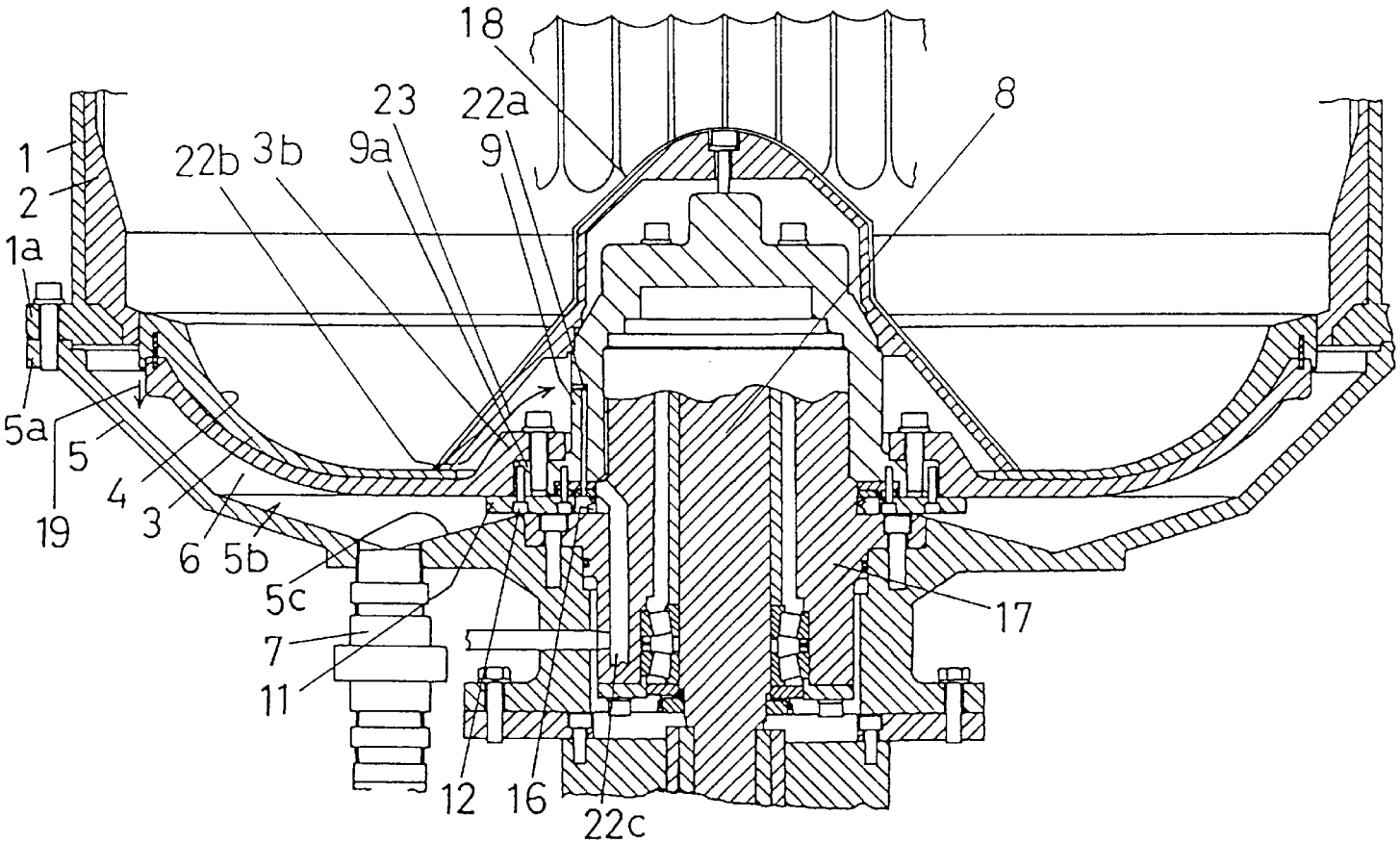
FIG. 3 is an enlarged sectional view of another preferred embodiment of the present invention, with some parts not shown.
Figure 4:
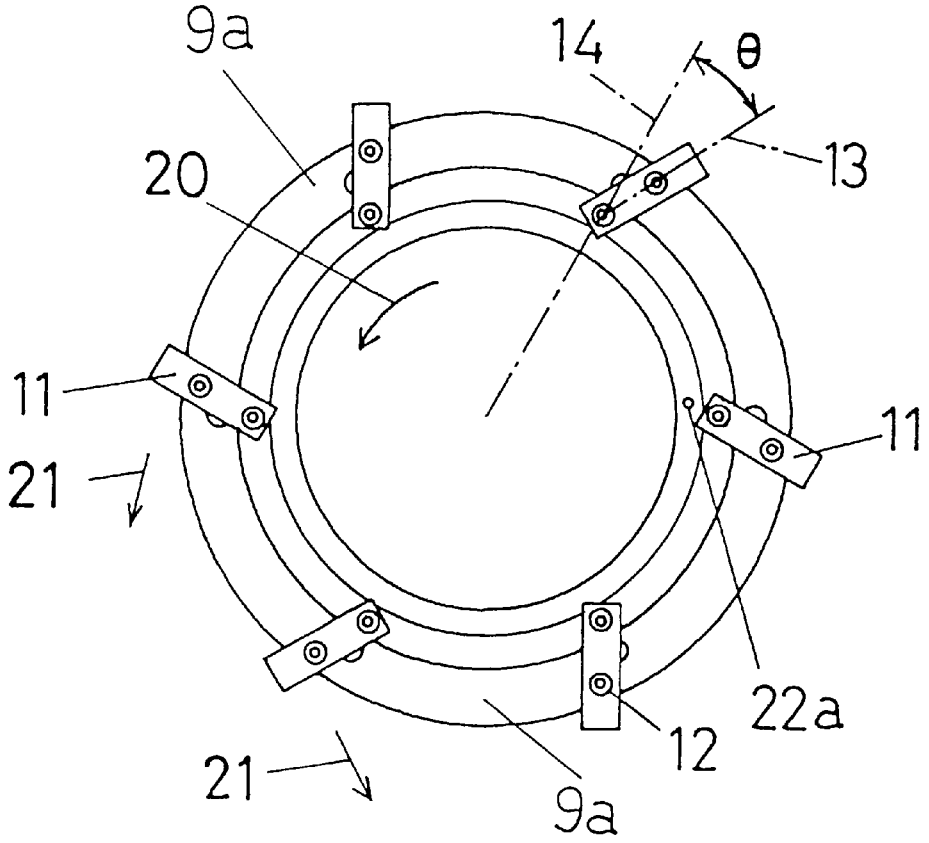
FIG. 4 is a diagram that describes how the blades and air inlet are arranged in the embodiment of FIG. 3.
Figure 5:
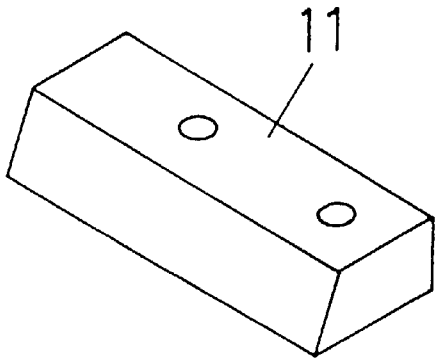
FIG. 5 is a perspective view of one of the blades in the embodiment of FIG. 3.

In the embodiment shown in FIG. 2, each individual blade 11 is fastened by a single bolt 12, and in the embodiment shown in FIG. 3, each individual blade 11 is fastened by two bolts 12 (FIGS. 3 and 4). Both of the embodiments are functionally equivalent, and provide the same results.

It is preferred that the blades 11 are mounted as near to the location of a seal 16 as possible. For example, the blades 11 may be mounted so that the ends of the blades on the side of the seat 16 lie within a distance of between 1 mm and 20 mm from the location of the seal 16. In the embodiment shown, the distance is chosen to be on the order of 10 mm.

In the embodiment, each individual blade 11 is mounted with its longitudinal center line 13 at an angle $\theta$=30 degrees with regard to the radius 14 of the rotating barrel 3 (FIG. 4). Further, the gap between the lower side of each individual blade 11 and the upper side of the outer bottom plate 5 on the side of the rotary shaft 8 is chosen to be 1 mm.

The outer end of each individual blade 11 (which is located on the side remote from the rotary shaft 8) extends slightly outwardly (toward the side remote from the rotary shaft 8) beyond the parallel plane of the outer bottom plate 5 (FIGS. 2 and 3). By employing this construction, any part of the abrasive media in its solid particle or liquid form that has been repelled by the blades 11 can easily flow toward the inner wall 5*c*.

FIG. 4 is simplified for illustrative purposes, and describes the bottom of the rotating barrel 3 as viewed from the rotating plate 3*a*. As seen from FIG. 4, an air inlet 22*a* is provided on the portion of the rotating barrel 3 that lies between the seal 16 and the blade 11. This air inlet communicates with the atmosphere through the boss 9. On the upper side of the boss 9, there is a boss cover 18 secured to the boss 9, which has a urethane coating on its upper side. On the lower end of the boss cover 18, there is an air inlet 22*b* through which air is introduced into the corresponding air inlet 22*a* (FIGS. 2 and 3).

The air inlets 22*a* and 22*b* are shown as one, respectively, although more than one air inlet may be provided, respectively. The number of the respective air inlets 22*a* and 22*b* will not affect the function and effect of the present invention.

In operation, a motor 15 is started up. Then, the rotary shaft 8 supported by the bearing 17 is rotated. The rotating barrel 3 is then rotated with the rotary shaft 8. While the rotating barrel 3 is rotating, part of the abrasive media including water and compound, which are contained in the rotating barrel 3 together with workpieces being surface finished and the like, passes through the gap between the stationary barrel 1 and rotating barrel 3, as shown by an arrow 19 in FIG. 2 and FIG. 3, and is gradually building up in solid particles or liquid on the outer bottom plate 5 of the stationary barrel 1.

As the rotating barrel 3 rotates as described above, the blades 11, which are fixed to the lower side of the annular flange 9*a* for mounting the boss 9 on the rotating barrel 3, also rotate.

In FIG. 4, as the blades 11 are rotated in the direction of an arrow 20, the part of the abrasive media in a solid particle or liquid form that is in contact with the blades 11 is repelled by the blades 11 in the direction of an arrow 21 (that is, in the direction remote from the rotary shaft 8), and forms a flow which causes the part of the abrasive media present in the neighborhood of the boss 9 to travel outwardly (in the direction remote from the rotary shaft 8 or toward the outlet pipe 7) as well. This flow of the abrasive media is forced to travel outwardly, developing a negative pressure (vacuum) in the area located between the bottom side of the annular flange 9*a* and the top side of the parallel plane of the outer bottom plate 5, and on the inner side of the blades 11 (on the side of the rotary shaft 8). The negative pressure that prevails in this negative pressure (vacuum) area draws air from the atmosphere through the air inlets 22*b* and 22*a*. As shown by an arrow 23 in FIG. 3, the air that is drawn from the atmosphere through the air inlet 22*b* goes through the air inlet 22*a,* entering the before described negative pressure (vacuum) area. The before described air, which has been drawn into the negative pressure (vacuum) area through the air inlets 22*b* and 22*a,* stays in the said negative pressure (vacuum) area, and forms an air layer in the negative pressure (vacuum) area This air layer prevents the abrasive media in its solid particle and/or liquid form from entering into the seal 16 or the area where the bearing 17 is sealed.

During the surface finishing or the like process, a mass composed of abrasive media including water and compound, if required, and workpieces is subjected to the centrifugal force produced by rotating the rotating barrel 3, which forces the mass against the stationary barrel 1 as shown by dot-dash lines in FIG. 2. Thus, the boss cover 18 is left uncovered by the mass, and is always exposed to the atmosphere, allowing air from the atmosphere to be drawn through the air inlets 22*a* and 22*b*.

It is not essential that air is drawn from inside the barrel through the air inlets 22*a,* 22*b* into the negative pressure (vacuum) area. Alternatively, an air inlet 22*c* may be provided as shown in FIGS. 2 and 3. Air may be drawn through the air inlet 22*c,* and then may be introduced from below the barrel through the sliding portion of the seal 16 into the negative pressure (vacuum) area where an air layer may be created A description has heretofore been provided for wet-type finishing, but the present invention may apply similarly to dry-type finishing, which contains no water or liquid form.

Although the present invention has been described with reference to the particular embodiments thereof, it should be understood that various changes and modifications may be made without departing from the scope and spirit of the present invention as claimed.

What is claimed is:

1. In a barrel finishing operation performed by a spiral-flow barrel finishing machine that includes a cylindrical stationary barrel having an outer bottom plate at a bottom end thereof and a rotating barrel rotatably mounted inside the cylindrical stationary barrel on a lower portion thereof in a spaced relationship with the stationary barrel, a method of protecting a seal in the spiral-flow barrel finishing machine comprising:

rotating at least one blade mounted on a back side of a rotating plate which forms a bottom end of the rotating barrel by rotating the rotating barrel;

repelling part of abrasive media which exists in solid particle or liquid form between a back side of the rotating plate and a top side of the outer bottom plate in a direction away from a rotary shaft for the rotating barrel by said rotating at least one blade;

developing a negative pressure or vacuum in a vacuum area located between the back side of the rotating plate and the top side of the outer bottom plate and on a side of the at least one blade nearer to the rotary shaft;

drawing air from the atmosphere into the vacuum area due to the presence of the negative pressure or vacuum in the vacuum area and thereby creating an air layer in the vacuum area; and allowing the air layer to prevent the abrasive media which exists in solid particle or liquid form from entering a seal or seal area where a bearing of the rotary shaft is sealed.

2. In a spiral-flow barrel finishing machine including a cylindrical stationary barrel having an outer bottom plate at a bottom end thereof and a rotating barrel rotatably mounted inside the stationary barrel on a lower portion thereof in a spaced relationship to the stationary barrel, the rotating barrel having a rotary shaft, a seal protecting apparatus comprising:

at least one blade mounted on a back side of a rotating plate which forms a bottom end of the rotating barrel and located in proximity to the rotary shaft; and at least one air inlet communicative with the atmosphere provided on a back side of the rotating plate and located on a side of said at least one blade nearer to the rotary shaft.

3. The spiral-flow barrel finishing machine of claim 2, wherein said at least one blade comprises a plurality of blades arranged at regular intervals circumferentially and coaxially with the rotary shaft for the rotating barrel.

4. The spiral-flow barrel finishing machine of claim 2, wherein said at least one blade and the outer bottom plate are spaced from each other by a gap that is as small as possible, with a bottom side of the at least one blade facing a top side of the outer bottom plate in a plane parallel with the top side.

* * * * *